United States Patent [19]

Thomas et al.

[11] Patent Number: 4,899,656

[45] Date of Patent: Feb. 13, 1990

[54] MACHINE FOR PROCESSING A CONTINUOUS WEB OR SHEETS

[75] Inventors: Hermann Thomas, Darmstadt; Josef Herd, Munster; Uwe Hasper, Seeheim, all of Fed. Rep. of Germany

[73] Assignee: Maschinenfabrik Goebel GmbH, Darmstadt, Fed. Rep. of Germany

[21] Appl. No.: 321,315

[22] Filed: Mar. 10, 1989

[30] Foreign Application Priority Data

Mar. 11, 1988 [DE] Fed. Rep. of Germany ..... 3808142

[51] Int. Cl.[4] ..... B41F 5/00

[52] U.S. Cl. ..... 101/216; 101/219; 226/194; 271/273

[58] Field of Search ..... 101/216, 219, 231, 232, 101/248, 132, 152, 153, 174, 178; 226/176, 177, 194; 400/636, 636.3; 271/314, 273, 274

[56] References Cited

U.S. PATENT DOCUMENTS

| | | | |
|---|---|---|---|
| 2,530,425 | 11/1950 | Eberhardt | 226/194 |
| 3,326,439 | 6/1967 | Sarka | 226/194 |
| 3,338,495 | 8/1967 | Motte | 226/177 |
| 3,413,919 | 12/1968 | Hocutt | 101/216 |
| 3,983,811 | 10/1976 | Fuchs et al. | 101/216 |
| 4,048,831 | 9/1977 | Fabian et al. | 226/177 |
| 4,470,592 | 9/1984 | Takahashi | 271/273 |

*Primary Examiner*—Eugene H. Eickholt

*Attorney, Agent, or Firm*—Watson, Cole, Grindle & Watson

[57] ABSTRACT

A pair of engaged cylinders of a machine for processing a continuous web or sheets passing between the cylinder nip has shafts journaled at opposite ends in a machine frame with pairs of first and second bearings for the shafts mounted on the machine frame for relative adjustment to each other and to the frame for adjusting the sides of the nip between the cylinders, at least one adjustable pressure medium cylinder acting between the frame and one of the casings of each pair being provided for effecting force flows to travel along parallel planes which contain the casing and bearing pair.

9 Claims, 3 Drawing Sheets

14,13
19,18
6
35
12,11
5
37
36

14,13
21,20
12,11
19,18
17,16
6
5
4b
15
4a
18a,19a
16a,17a
20a,21a
4

4
3
18
13
6
20
11
5
16
3
4b
4a

MACHINE FOR PROCESSING A CONTINUOUS WEB OR SHEETS

RELATED APPLICATION

This application relates to U.S. Ser. No. 311,347, filed Feb. 15, 1989, and commonly owned herewith.

BACKGROUND OF THE INVENTION

This invention relates to a machine having a pair of cylinders for processing a continuous web or sheets, such as paper, fabric, foil, plastic material, metallic material, or the like, passing between the nip of cylinders. The shafts of the cylinders are journalled at opposite ends in the frame of the machine, and two sets of bearings are provided for each of the journalled shafts, each of such bearings being supported in an auxiliary casing which is subjected to a tension producing device such as a pressure medium cylinder for adjusting the gap between the machine cylinders.

U.S. Pat. No. 3,256,812 discloses a printing machine in which the spacing of the impression and printing cylinders are capable of being regulated during machine operation by the provision of tapered members mounted between bearing housings of the cylinders.

DE-AS No. 20 33 515 discloses a single cylinder in which the journal shafts, and consequently the cylinder itself, is intended to be bent by means of pressure-generating cylinders. The engaged pressure-generating cylinders act at the axial outer ends of the journals, and a fixed bearing is located at the axial inner end of each journal. Consequently, because of the flexing forces acting thereon, such cylinder can adjust to the flexure of another cylinder of the machine. Thus, only one cylinder is flexed while such other cylinder remains unaffected.

British Pat. No. 1,158,757 discloses a bearing arrangement for a pair of shafts carrying cooperating rolls wherein two bearings are provided for each journal of an engaged cylinder. The roller distance is said to be precisely adjusted such that each of the bearings is located in a auxiliary casing and all bearings of each cylinder journal can be pressed against one another by a pressure-generating device in such a manner that any play between the bearings is eliminated. However, none of the bearings is directly located in a corresponding frame which supports the cylinder pair. Moreover, the adjustment of the distance between the axis of the two cylinders is rather cumbersome, since this would require the delicate adjustment of a wedge against the friction forces acting thereon, without reliance on any type of control mechanism. A time consuming effort is therefore required to precisely position the wedge.

SUMMARY OF THE INVENTION

It is therefore an object of the present invention to solve the problems encountered with prior machines of the aforementioned type by the provision of a bearing arrangement which can be easily serviced and extensively adjusted, even during machine operation, to variable or varying modes of operation of the engaged machine cylinders. The arrangement according to the invention controls the forces which occur during the operation of the engaged machine cylinders in such a manner that flexure of all the involved machine elements is minimal and controllable.

According to the invention a first pair of auxiliary casings support first bearings on the ends of the cylinder shafts and lie in a first plane, a second pair of auxiliary casings adjacent the first casings support second bearings on the ends of the cylinder shafts and lie in a second plane. The planes lie parallel to each other and perpendicular to the shafts. Both pairs of casings are mounted on the frame for relative adjustment of the casings of each pair of one another and to the frame along the planes. At least one pressure medium cylinder means acts between the frame and at least one of the casings of the first pair for effecting such relative adjustment thereof, and at least one second pressure medium cylinder means acts between the frame and at least one of the casings of the second pair for effecting the relative adjustment thereof independently of the relative adjustment of the first pair, such that the size of the nip between the cylinders is adjustable and force flows between the shafts and the frame are concentrated along each of the planes, one plane lying closer to the cylinders and the other lying outwardly thereof such that the two force flows, beginning at the frame, flow first through a casing for one of the cylinders, through the casing of the other cylinder and into the frame, and thereafter in counterflow.

With such an arrangement, the flow of forces involved in the flexure of the machine cylinders passes directly along the machine frame so that within practical limits there is no, or only minimal flexing of the frame. Moreover, it is possible to set or readjust the flexure of the cylinders or other parts of the machine so that it becomes possible to select and control flexure of the cylinders within broad limits. This includes the capability to adjust or readjust automatically or manually, the flexure of the cylinders or a flexure which, during machine operation, runs counter to the forces acting on the cylinders even during machine operation. It is possible during machine operation to set the flexure, or a counterflexure which cancels out the flexure, so as to be variable by the provision of a program that can be regulated and which can operate automatically, whereby the pressure within the pressure medium cylinders need not drop temporarily to zero.

The bearings provided can be either slide bearings or roller bearings, or may comprise side-by-side bearings, i.e., multiple row bearings. The pressures in each cylinder can be set, controlled or regulated either separately for each cylinder or jointly as a group of cylinders, automatically or manually.

Additional pressure medium cylinders may be provided between the other casing and the frame of each pair, and between casings of each of the pairs. Otherwise, axially adjustable tension jacks or stop screws may be substituted for all but one of the pressure medium cylinders acting between one of the casings and the frame of each pair.

BRIEF DESCRIPTION OF THE DRAWINGS

The invention is described in more detail when taken in conjunction with the accompanying drawings which, for the sake of clarity, exclude non-essential machine elements otherwise known to one having skill in this art.

DETAILED DESCRIPTION OF THE INVENTION

A continuous web or sheet 1 of paper foil, fabric, plastic, metal or the like moves between the nip of a pair of machine cylinders 2 and 3 to be processed. The process may consist of a printing operation in which case one of the cylinders comprises an impression cylinder and the other a pressure cylinder. Otherwise, the cylinders can be adapted for effecting transverse and/or longitudinal cuts, perforations or fold lines with the use of suitable elements (not shown) on one or both cylinders. And, other web or sheet processing can be carried out by the cylinder pair without departing from the invention.

To absorb the forces acting on the engaged cylinders during processing, each cylinder is provided with a cylinder journal. These journals or cylinder shafts extend outwardly of opposite ends of their respective cylinders. The bearing application of the cylinder journals is basically the same for each journal. The journals of the two engaged cylinders 2 and 3, however, act jointly with one another in a manner similar to that of the engaged cylinders themselves. Since the bearing application of the journals is basically the same for both ends of the cylinders, one or both end journals can be extended for supporting a gear wheel or the like for driving the cylinders. Only the bearing application at one end of the engaged cylinders will be described hereinafter since the bearing application at the other end is basically the same.

Figure 1:
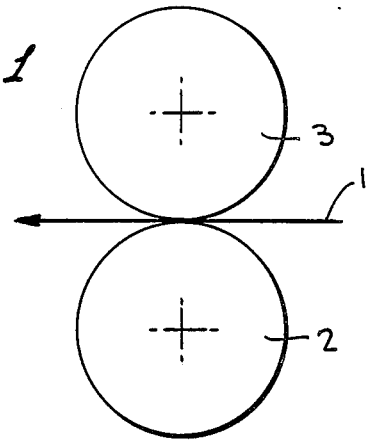
FIG. 1 is a schematic side-elevational view of a pair of cylinder rolls of the machine showing a continuous web or sheet passing through the roll nip.
Figure 3:
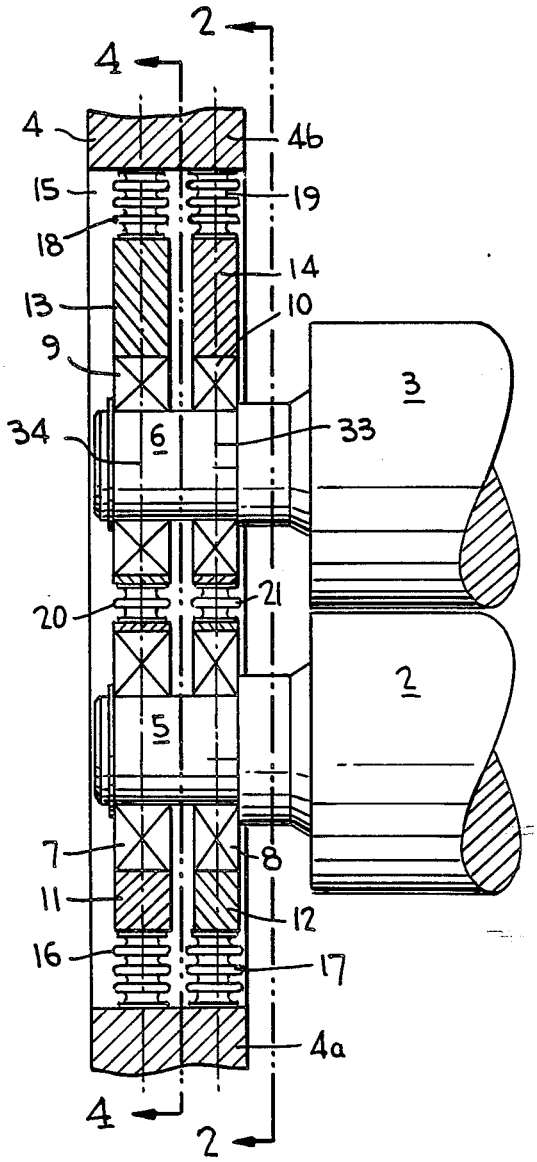
FIG. 3 is a view taken substantially along the line 3—3 of FIG. 2.

Cylinder 2 is shown in FIGS. 1 and 3 as a bottom cylinder and cylinder 3 as a top cylinder of the cylinder pair mounted one above the other in a machine frame 4. However, the cylinders may be positioned side-by-side on the frame so that the continuous web or sheet 1 to be processed moves in a vertical direction between the cylinders. Also, the cylinders may be mounted diagonally on the frame or one above the other such that cylinder 2 is uppermost and cylinder 3 is lowermost, without departing from the invention.

Cylinder 2 has a journal or shaft 5 and cylinder 3 has a journal or shaft 6. Each cylinder journal has two bearings arranged adjacent one another in an axial direction of the cylinder. These bearings can be slide bearings or roller bearings, the latter of which can include several rows of roller elements arranged side-by-side in an axial direction of the cylinder so as to provide multiple row roller bearings.

Bearings 7 and 8 are provided on journal 5, and bearings 9 and 10 are provided on journal 6. The bearings are independently movable as anti-friction elements, and bearings 7–10 are respectively supported within auxiliary casings 11–14. The casings are mounted on the machine frame within an opening 15, or in a corresponding recess of the frame. In such manner, upper and lower frame sections 4*a* and 4*b* are defined.

Figure 2:
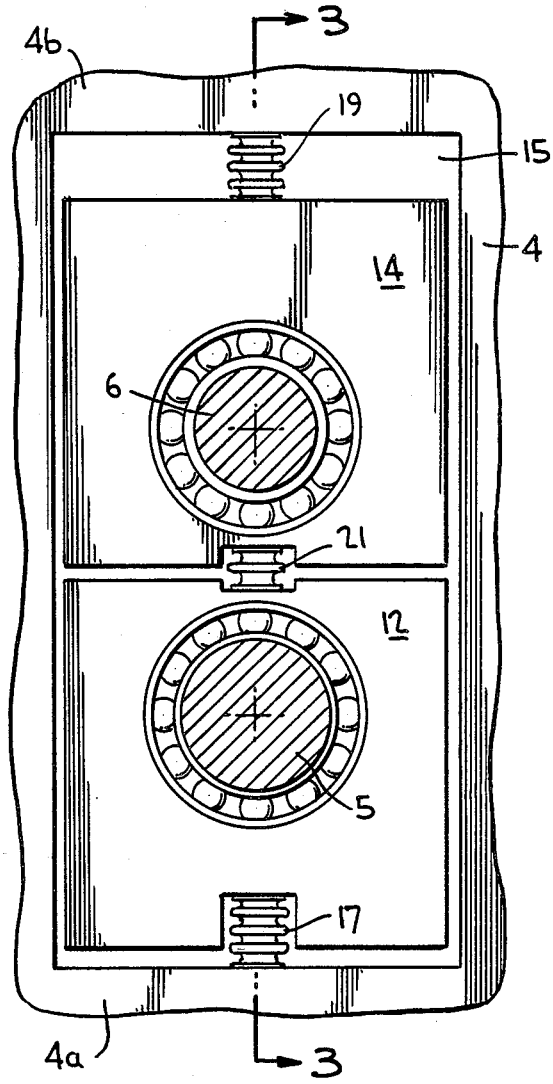
FIG. 2 is a vertical elevational view, partly in section, taken substantially along the line 2—2 of FIG. 3.

Casings 12 and 14 and bearings 8 and 10 supported thereby lie in a first plane 33, and casings 11 and 13 and bearings 7 and 9 supported thereby lie in a second plane 34 located outwardly of the first plane and parallel thereto with the planes perpendicular to the central axes of the cylinders. Pressure medium cylinders 16 and 18 (FIG. 4) respectively act between the frame and casings 11 and 13, and a pressure medium cylinder 20 acts between casings 11 and 13. The three pressure medium cylinders lie in plane 34. Similarly, pressure medium cylinders 17 and 19 (FIG. 2) respectively act between the machine frame and casings 12 and 14, and a pressure medium cylinder 21 acts between casings 12 and 14. All three of these pressure medium cylinders lie in plane 33.

Figures 4, 5, 6:
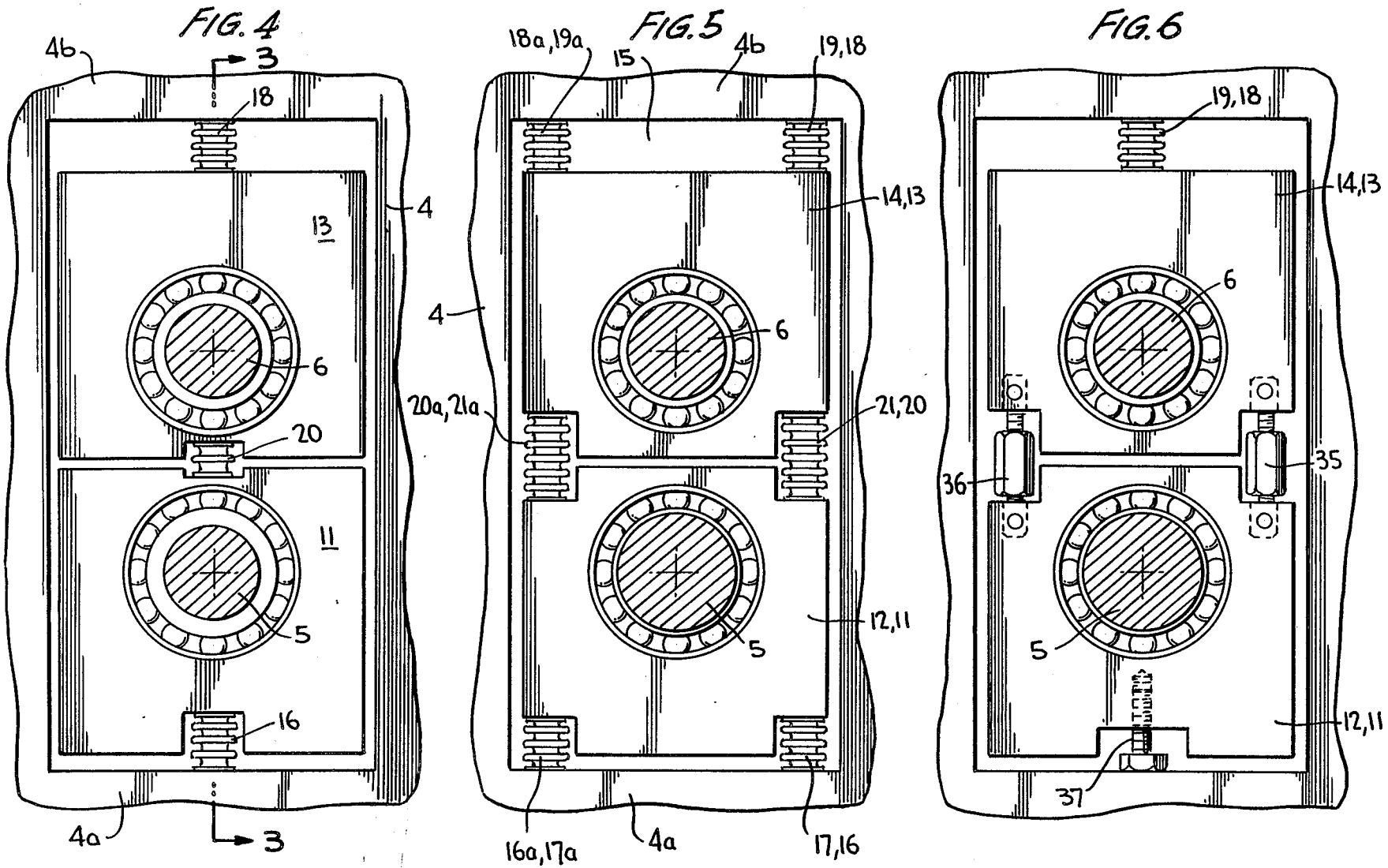
FIG. 4 is a view similar to FIG. 2 taken substantially along the line 4—4 of FIG. 3.
FIG. 5 is a view similar to FIGS. 2 and 4 of another embodiment of the invention.
FIG. 6 is a view similar to FIG. 5 of yet another embodiment according to the invention.

As shown in FIG. 5, more than one pressure medium cylinder can act between the casings of each pair and between the frame and the casings of each pair, such that pressure medium cylinders 16, 16*a*, 18, 18*a*, 20, 20*a* are located in plane 34, and pressure medium cylinders 17, 17*a*, 19, 19*a*, 21, 21*a* are located in plane 33.

In lieu of all the pressure medium cylinders except for pressure medium cylinders 18 and 19 acting between casings 14 and 13 and the frame, tension jacks 35 and 36 may act between the casings (FIG. 6), and an axially adjustable stop 37 may act between the frame and each of casings 11 and 12. With such arrangement, however, at least one pressure medium cylinder for each pair of journals of the engaged cylinders remains in place for the arrangement shown in FIG. 6, so that it is possible to exert, as desired, different or alternating or varying forces during machine operation.

Figure 7:
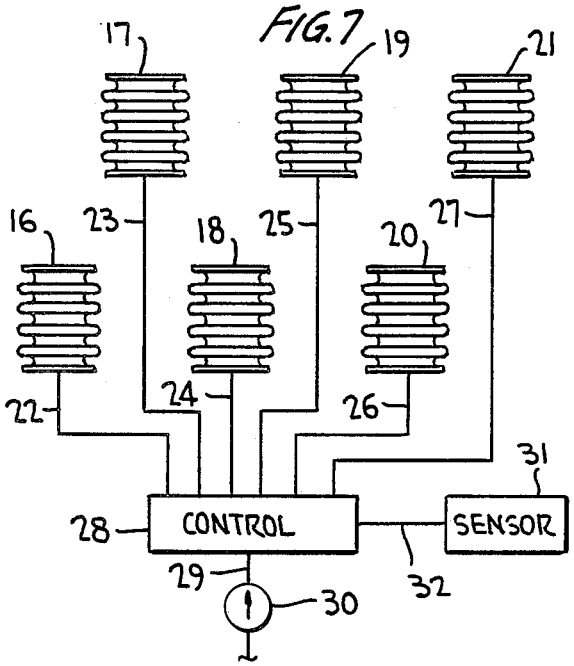
FIGS. 7, 8 and 9 are views showing optional pressure control arrangements for the pressure medium cylinders.

As illustrated in FIG. 7, pressure medium cylinders 16, 17, 18, 19, 20 and 21 are separately connected by hydraulic lines 22, 23, 24, 25, 26 and 27 through a control or regulating device 28 provided for setting, controlling or regulating the hydraulic fluids supplied via a hydraulic line 29 and a pump 30. For automatic control, a sensor 31 is connected to the control device through a (hydraulic) line 32. The sensor may, for example, signal the flexure of cylinder 2 and/or cylinder 3 and cause the control device to supply pressurized medium corresponding to pressure medium cylinders 16–20 via lines 22–27. The pressure existing in the various pressure lines for the pressure medium cylinders can either be the same or different from one another, or can be the same within groups so that, for example, two or three of the lines will supply the same pressure and different pressures will be supplied to the other lines. In such manner pressure cylinders 16–21 develop different forces in accordance with selected pressures. These forces can be adjusted while the machine is operating or they can be preset or adjusted before machine operation. Moreover, these pressures can be changed or modulated during machine operation. In such manner the pressures existing within the pressure cylinders can, for example, be reduced or increased and optionally set, for example to zero. As a result there are extensive choices for adjusting cylinder 2 and cylinder 3 during machine operation, particularly the size of the gap between them, their position toward one another, or to compensate for the deflection of engaged machine elements. In such manner any play existing within the engaged bearings or machine elements can be eliminated at the same time. The pressure adjustment of control unit 28 can be readjusted, for example, in accordance with the operating speed of cylinders 2 and 3, or in accordance with the speed of rotation of such cylinders. For example, relatively low pressures can be utilized for low rotational speeds and relatively higher pressure can be utilized for faster rotational speeds.

The pressure medium cylinders, which may comprise metallic bellows cylinders, are capable of tolerating the application of relatively strong pressures.

Figure 8:
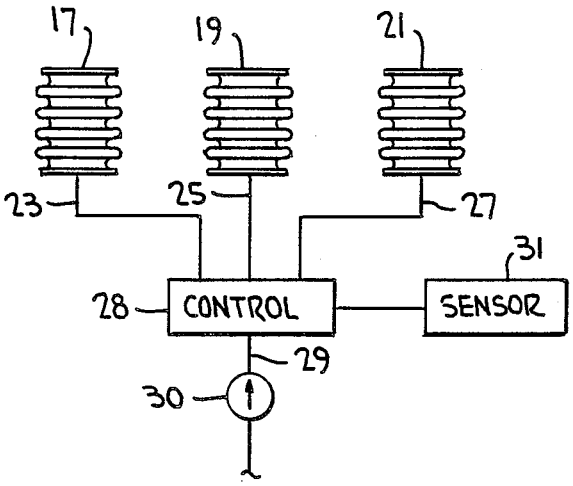
Figure 9:
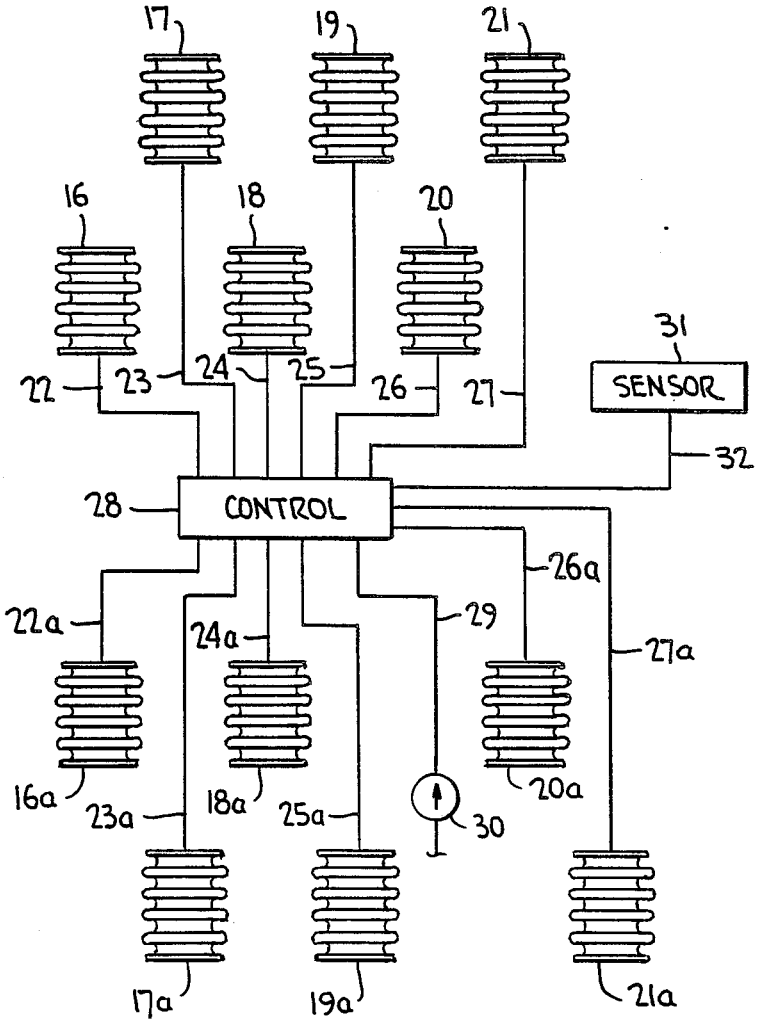

FIGS. 8 and 9 show other arrangements for control of the groups of pressure medium cylinders.

As a result of the forces developed in pressure medium cylinders 19, 21, 17 (FIGS. 3 and 4), a force flow is created in bearings 8 and 10 which also flows through cylinder journals 5 and 6. Movement of these force flows occurs along plane 33 illustrated by a straight phantom line in FIG. 3. This flow commences, for example, in section 4b of frame 4, flows through pressure medium cylinder 19, casing 14, bearing 10, cylinder journal 6, pressure medium cylinder 21, casing 12, bearing 8, cylinder journal 5, again through bearing 8 and again through casing 12, pressure medium cylinder 17, and then reaches section 4a of frame 4, thus returning again to the frame. The force flow can also flow in the opposite direction.

A second force flow develops adjacent the first force flow, parallel thereto, and along plane 34 as represented by a straight phantom line in FIG. 3. This second flow is located further outwardly of cylinders 2 and 3 compared to the first force flow and therefore acts on the cylinder journals further out. The outer force flow moves, for example, also from section **4*b* of frame 4, through pressure medium cylinder 18, casing 13, bearing 9, cylinder journal 6, again through bearing 9 and casing 13, pressure medium cylinder 20, casing 11, bearing 7, cylinder journal 5, again through bearing 7 and casing 11, pressure medium cylinder 6 and from there also reaches section 4*a* of frame 4**.

Instead of the two aforedescribed force flows, the present structural arrangement could be altered to provide several force lines developed parallel to the axial direction of cylinders 2 and 3.

Since the pressure medium cylinders can optionally be supplied with pressure individually, the two force flows along planes 33 and 34 as aforedescribed are appropriately created which are independent of one another and basically flow along paralled lines at least in those sectors of the machine frame in which the pressure cylinders are installed. The machine frame is, however, the same in all cases since cylinders 2 and 3 are mounted in openings or recesses of the frame. And, the forces may flow from section **4*b* to section 4*a* or in the reverse at equal strengths from section 4*a* to section 4*b***.

According to the present arrangement the distance between cylinders 2 and 3 can be delicately adjusted within wide limits in accordance with given requirements. Forces exerting influence at any time can also be adjusted, preset or, if required, continuously readjusted during machine operation within wide limits. If variations and adjustments need not be as numerous and far reaching as aforedescribed, and in the interest of economy, some of the pressure medium cylinders such as 16, 17, 20 and 21 can be replaced by movable wedges, adjustable tension jacks 35, 36 or axially adjustable stop screws (FIG. 6), all being known devices. However, at least one pressure cylinder lying in each of planes 33 and 34, such as pressure medium cylinders 18 and 19, remain in place so that the forces acting on the cylinder journals may be readjusted as necessary even during machine operation, i.e., while cylinders 2 and 3 are rotating. Moreover, the pressure medium cylinders may be pressurized individually or as groups, in series or in parallel.

Obviously, many other modifications and variations of the present invention are made possible in the light of the above teachings. It is therefore to be understood that within the scope of the appended claims the invention may be practiced otherwise than as specifically described.

What is claimed is:

1. In a machine having a pair of cylinders for processing a continuous web or sheets passing between the nip thereof, the cylinders having shafts journalled at opposite ends in a frame of the machine, the size of the nip between said cylinders being adjustable, a first pair of auxiliary casings supporting first bearings on the ends of said shafts and lying in a first plane, a second pair of auxiliary casings adjacent said first casings and supporting second bearings on the ends of said shafts and lying in a second plane, said planes lying parallel to each other and perpendicular to said shafts, said pairs being mounted on said frame for relative adjustment of said casings of each pair to one another and to said frame along said planes, at least one first pressure medium cylinder means acting between said frame and at least one of said casings of said first pair, for effecting said relative adjustment thereof, at least one second pressure medium cylinder means acting between said frame and at least one of said casings of said second pair for effecting said relative adjustment independently of said relative adjustment of said first pair, whereby the size of the nip between the cylinders is adjustable and force flows between said shafts and said frame are caused to travel along each of said planes.

2. The machine according to claim 1, wherein at least another first pressure medium cylinder means acts between said frame and the other of said casings of said first pair for effecting said relative adjustment thereof and at least another second pressure medium cylinder means acts between said frame and the other of said casings of said second pair for effecting said relative adjustment thereof.

3. The machine according to claim 1, wherein at least a further first pressure cylinder means acts between said casings of said first pair for effecting said relative adjustment thereof, and at least a further second pressure medium cylinder means acts between said casings of said second pair for effecting said relative adjustment thereof.

4. The machine according to claim 1, wherein a plurality of said first and second pressure medium cylinder means are provided.

5. The machine according to claim 2, wherein a plurality of said first and second pressure medium cylinder means are provided.

6. The machine according to claim 3, wherein a plurality of said first and second pressure medium cylinder means are provided.

7. The machine according to claims 1, 2, 3, 4, 5 or 6, wherein control means are provided for selectively pressurizing said pressure medium cylinder means individually or in selected groups.

8. The machine according to claim 1, wherein axially adjustable means acts between said frame and the other of said casings of said first pair and of said second pair.

9. The machine according to claim 1, wherein axially adjustable means acts between said casings of said first pair and between said casings of said second pair.

* * * * *